US007152855B1

(12) United States Patent
Martens

(10) Patent No.: US 7,152,855 B1
(45) Date of Patent: Dec. 26, 2006

(54) VISE JAW WITH WORK STOP

(76) Inventor: Michael R. Martens, 7543 Hardy St., Orangevale, CA (US) 95662

( * ) Notice: Subject to any disclaimer, the term of this patent is extended or adjusted under 35 U.S.C. 154(b) by 143 days.

(21) Appl. No.: 10/820,684

(22) Filed: Apr. 7, 2004

(51) Int. Cl.
*B25B 1/24* (2006.01)

(52) U.S. Cl. ..... 269/283; 269/303; 269/315

(58) Field of Classification Search ..... 269/279, 269/280, 282, 283, 303, 315
See application file for complete search history.

(56) References Cited

U.S. PATENT DOCUMENTS

| | | | | |
|---|---|---|---|---|
| 133,423 | A * | 11/1872 | Demmon et al. | 269/283 |
| 2,770,156 | A * | 11/1956 | Brettrager | 269/283 |
| 3,810,311 | A | 5/1974 | Pingel | |
| 4,030,718 | A | 6/1977 | Philipoff | |
| 4,635,912 | A | 1/1987 | Donnelly | |
| 5,018,562 | A | 5/1991 | Adams | |
| 5,996,986 | A | 12/1999 | Ewing | |
| 6,029,967 | A | 2/2000 | Wolfe | |
| 6,217,014 | B1 | 4/2001 | Wolfe | |
| 2003/0071404 | A1 | 4/2003 | Cairns | |
| 2003/0102615 | A1 | 6/2003 | Bentley | |

* cited by examiner

*Primary Examiner*—Robert C. Watson
(74) *Attorney, Agent, or Firm*—Heisler & Associates

(57) ABSTRACT

A vise jaw is provided which is configured to support a stop to provide precise and secure positioning of a work piece within a vise in both a primary horizontal direction and in a lateral horizontal direction. The jaw includes at least one slot, preferably in the form of a groove, intersecting with a face of the jaw. A stop is provided, such as in the form of a key, which includes a free portion and a captured portion. The captured portion is contoured to fit within the groove while the free portion extends out of the groove and beyond the face of the jaw. A bore in the key can be aligned with a threaded hole in the groove so that a threaded fastener can secure the key within the groove. The free portion abuts the work and resists lateral motion of the work.

34 Claims, 5 Drawing Sheets

VISE JAW WITH WORK STOP

FIELD OF THE INVENTION

The following invention relates to vise jaws for attachment to portions of a vise which hold a work piece, such as for performing machining operations upon the work. More particularly, this invention relates to stops attachable to vise jaws and otherwise integrated into vise jaws which resist lateral movement of a work piece held within a vise.

BACKGROUND OF THE INVENTION

When a work piece is to be machined or otherwise operated upon, it is often important that the work piece be held fixed and at a precise position. Commonly a vise is utilized to hold the work in a fixed position relative to machines which operate upon the work, such as a drill or milling machine. The vise typically includes two opposing ends with one of the ends being fixed and the other end adapted to move toward and away from the fixed end. Jaws are typically provided upon these ends with the jaws coming into direct contact with the work being held.

Such standard vises do a particularly good job of supporting the work in a manner resisting motion and properly positioning the work in a vertical direction, due to the base underlying the work; and in a first horizontal direction aligned with a direction that the moving end of the vise moves relative to the fixed end of the vise, through resistance provided directly by the jaws of the vise. However, horizontal motion of the work relative to the vise in a direction lateral to the direction of motion of the ends of the vise is only resisted through friction forces between the work and the jaws. These friction forces vary based on the surface condition of the jaws, the surface condition of the work and the amount of tightening force with which the jaws engage the work. If these friction forces are exceeded by forces applied to the work by a milling machine or other tool, the work will slide within the jaws, potentially destroying the work, damaging the milling machine or other tool, or otherwise providing negative results. Even if the work is held tight, it is difficult to precisely position work pieces in the same desired location reliably, especially in this lateral horizontal direction.

Various attempts have been made in the prior art to provide mechanical stops to support the work laterally, so that a position of the work within the jaw can be held fixed and at a desired location with forces other than merely friction forces. Such prior art attempts are cataloged in the following prior art patents and published applications: Pingel, U.S. Pat. No. 3,810,311; Philipoff, U.S. Pat. No. 4,030,718; Donnelly, U.S. Pat. No. 4,635,912; Adams, U.S. Pat. No. 5,018,562; Ewing, U.S. Pat. No. 5,996,986; Wolfe, U.S. Pat. No. 6,029,967; Wolfe, U.S. Pat. No. 6,217,014; Cairns, U.S. Publication No. 2003/0071404; and Bentley, U.S. Publication No. 2003/0102615.

Many of these prior art mechanical stops attach to the base of the vise, or other structures other than directly to the vise jaws. Such an arrangement is more difficult to calibrate and use on a variety of different machines with which the vise is associated. When such prior art mechanical stops are coupled directly to the vise jaws, themselves, the complexity of the mechanical stops inhibit their use in a quick and convenient fashion.

Additionally, many such devices provide less than fully satisfactory resistance to lateral motion of the work by relying on friction forces to some extent, rather than purely upon the strength of the materials from which the stop is made directly. For instance, the patent to Wolfe (U.S. Pat. No. 6,029,967) provides a sliding stop which resides within a channel in a top of a vise jaw. The sliding stop has a tightening mechanism so that it can be secured at the desired position within the channel. However, this tightening mechanism relies upon friction itself to hold the sliding stop in position. Hence, the risk of sliding of the stop is not entirely alleviated. Additionally, as such tightening mechanisms wear out, the effectiveness of such sliding stops can tend to degrade over time. Additionally, such a sliding stop mechanism and associated channel have a fairly significant degree of complexity, making their convenient use more difficult and resulting in additional cost to manufacture such prior art mechanical stops.

Accordingly, a need exists for a work stop which can be conveniently used with a vise jaw and which can securely hold the work in position relative to the jaw without reliance upon friction forces and which has sufficient simplicity to facilitate convenient use and low cost.

SUMMARY OF THE INVENTION

The vise jaw with work stop of this invention conveniently provides a vise jaw which is slightly modified to receive one or more work stops for resisting lateral motion of a work piece held within the vise and between opposing jaws of the vise. The vise jaw itself includes at least one slot which intersects with a face of the jaw. The slot can take on various different geometries, but most preferably is in the form of a groove extending perpendicularly from the face and formed within the top of the jaw. The slot preferably has tapering walls extending from the top down to a floor of the slot.

A stop is provided including a free portion and a captured portion. The captured portion is configured to reside within the slot with the free portion adapted to extend out of the slot and beyond the face of the jaw. In this way, the free portion is available to resist lateral motion of the work when the work is held between opposing jaws of the vise. In the preferred embodiment multiple such slots are provided so that a user can place one or more stops in the desired slots to resist lateral motion of the work relative to the vise.

The captured portion of the stop preferably has a size and shape complemental with a size and shape of the slots formed in the jaw. Thus, the captured portion can reside within the slot and resist lateral motion due to the work pressing upon the free portion of the stop, due to the geometry of the slot resisting lateral motion of the captured portion. The particular geometry of the slot and captured portion can vary, but most preferably is in the form of a groove with a substantially constant cross-sectional contour and with the captured portion of the stops having a complemental constant cross-sectional contour extending along the captured portion of the stop.

In one embodiment such grooves are configured with tapering walls extending down to a horizontal floor. In other embodiments, the grooves can be configured as "V-grooves" with tapering walls and no floor, or configured as troughs having a curving contour, or as holes with a circular cross-section located below the top of the vise jaw.

While the captured portions of the stops preferably have a size and shape complemental with that of the slots, it is only strictly necessary that the captured portions of the stop have a size and shape which allows the captured portions of the stops to reside within one of the slots. Most preferably, a threaded hole is provided within the slot and a bore is provided within the stop so that a threaded fastener can pass through the bore and into the threaded hole to further secure the stop within the slot. While the free portion of the stop can have any of a variety of different geometries, it most preferably has vertical side surfaces to provide a maximum surface contact between the stop and lateral sides of the work, to most effectively resist any lateral movement of the work relative to the vise.

OBJECTS OF THE INVENTION

Accordingly, a primary object of the present invention is to provide a vise jaw which includes a stop for resisting lateral motion of a work piece held within the vise.

Another object of the present invention is to provide a vise jaw with work stop which can have the work stop positioned relative to the vise jaw at a variety of different positions.

Another object of the present invention is to provide a vise jaw with work stop that has a stop which can be easily and conveniently moved from one location to another location upon the vise jaw and held securely adjacent the vise jaw.

Another object of the present invention is to provide a vise jaw with work stop which is of simple construction and is easy to use and reposition, while effectively resisting any lateral motion of a work piece held within the vise.

Another object of the present invention is to provide a vise jaw with work stop which includes a stop having geometries that work effectively with geometries in the vise jaw to allow the work stop to be held securely in a fixed position relative to the vise jaw.

Other further objects of the present invention will become apparent from a careful reading of the included drawing figures, the claims and detailed description of the invention.

DESCRIPTION OF THE PREFERRED EMBODIMENT

Figures 1, 2:
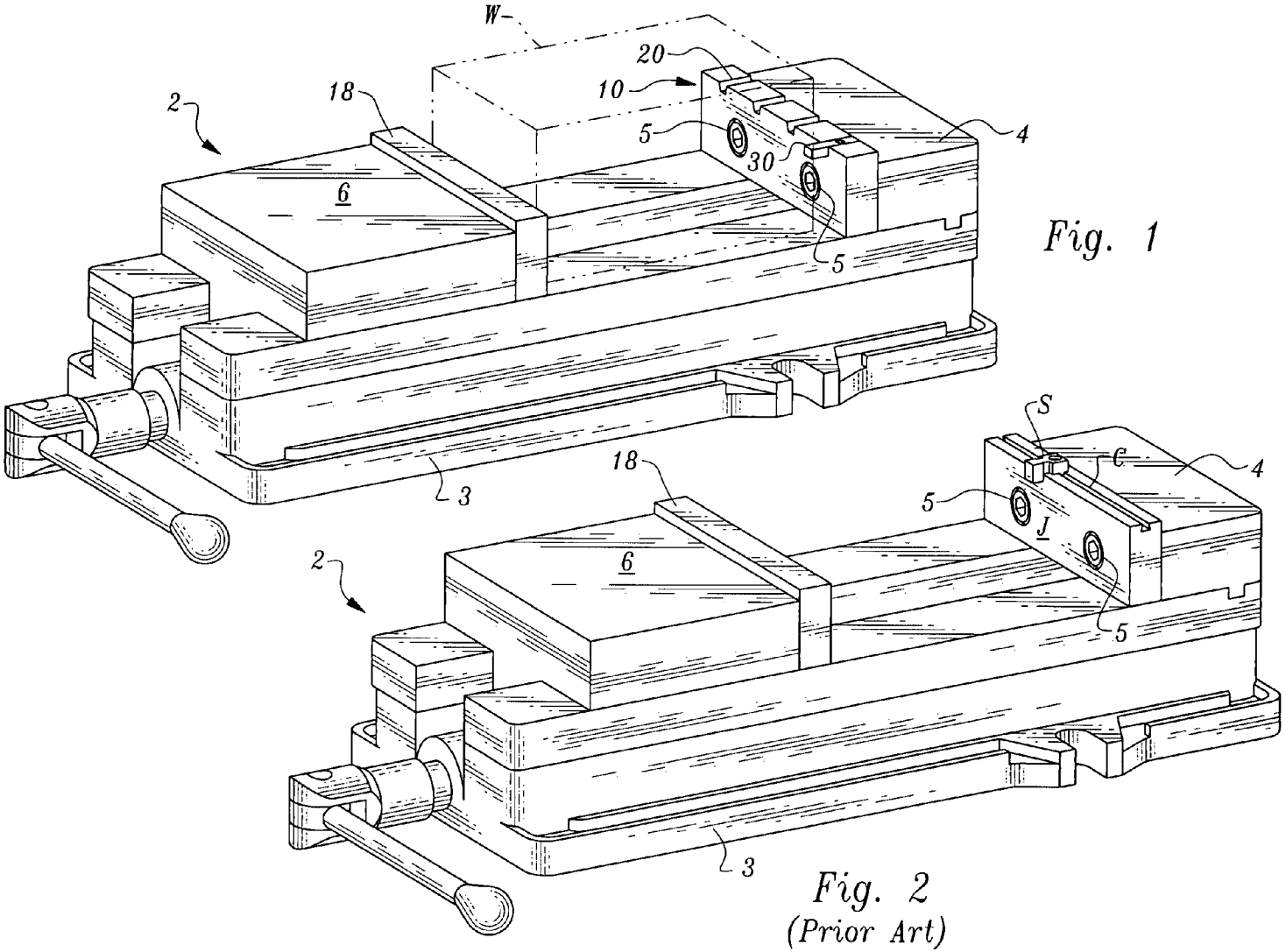
Fig. 2 (Prior Art)
FIG. 1 is a perspective view of a vise with the vise jaw and work stop of this invention included thereon and in use supporting a work piece between jaws thereof.
FIG. 2 is a perspective view of a prior art vise jaw including a mechanical work stop thereon.

Referring to the drawings, wherein like reference numerals represent like parts throughout the various drawing figures, reference numeral 10 is directed to a vise jaw (FIG. 1) for use with a vise 2. The jaw 10 is particularly configured to support a key 30 or other form of stop to prevent lateral motion of a work piece W adjacent the jaw 10. The work W is thus held in fixed position so that machining or other operations upon the work W can be performed without the work W moving, especially laterally and to place the work W precisely where desired.

Figure 3:
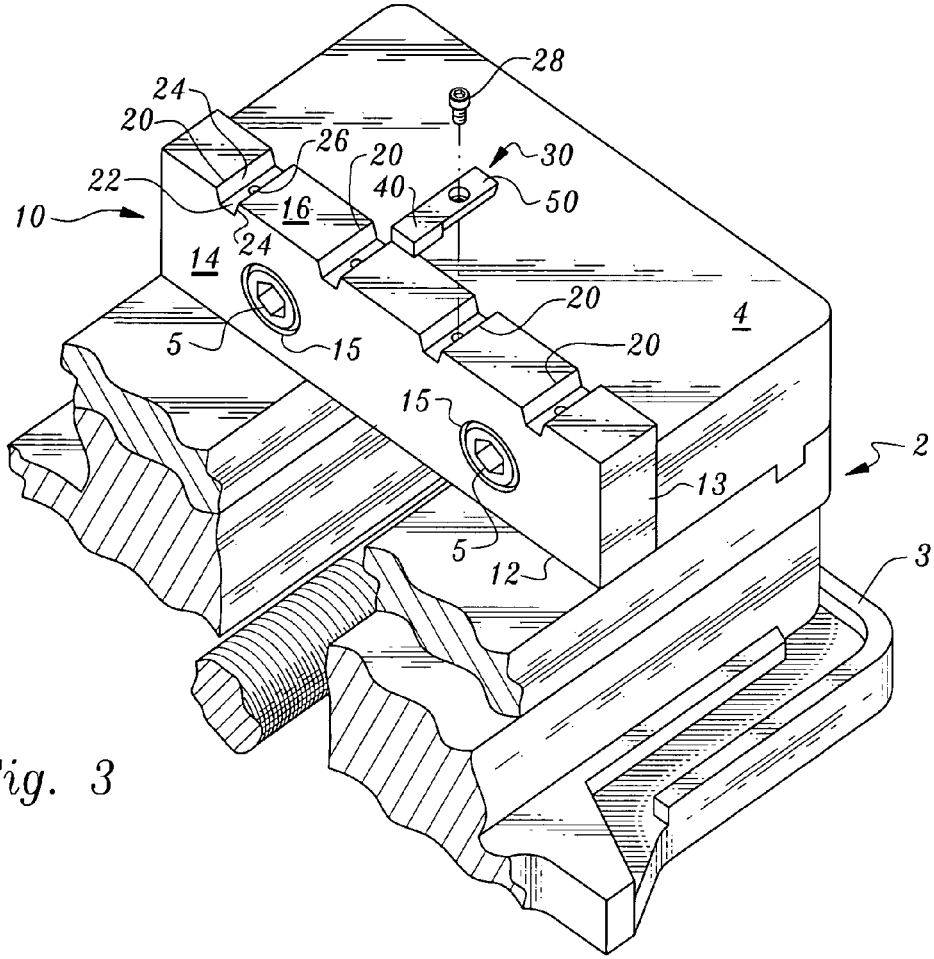
FIG. 3 is a perspective view of a portion of that which is shown in FIG. 1 and with a work stop portion of the invention exploded away from a vise jaw portion of the invention, and with an associated fastener shown exploded away from the work stop and the vise jaw, to illustrate how the stop is attached to the vise jaw.
Figure 4:
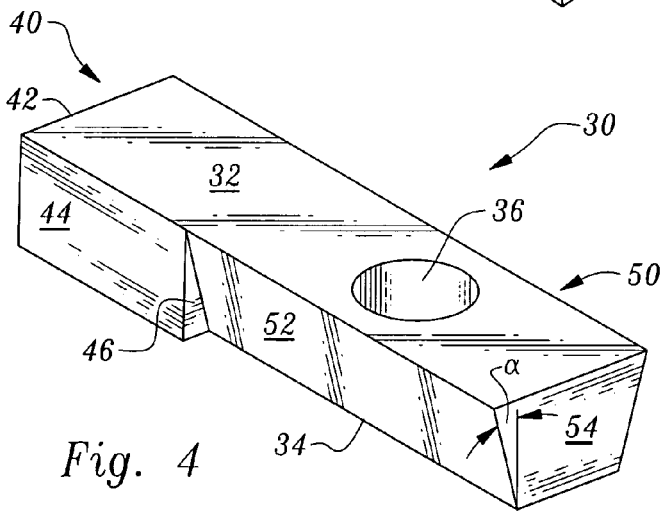
FIG. 4 is a perspective view of the stop according to a preferred embodiment when viewed from above.
Figure 8:
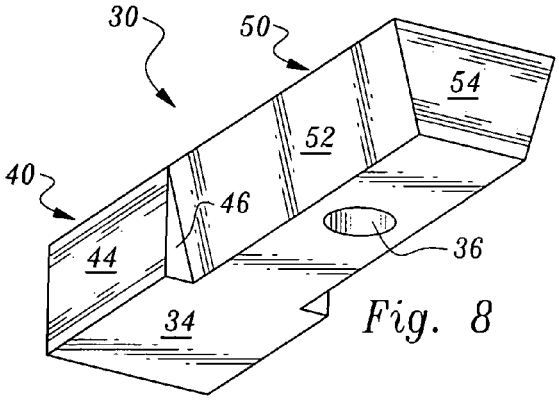
FIG. 8 is a perspective view of that which is shown in FIG. 4 when viewed from below.
Figure 9:
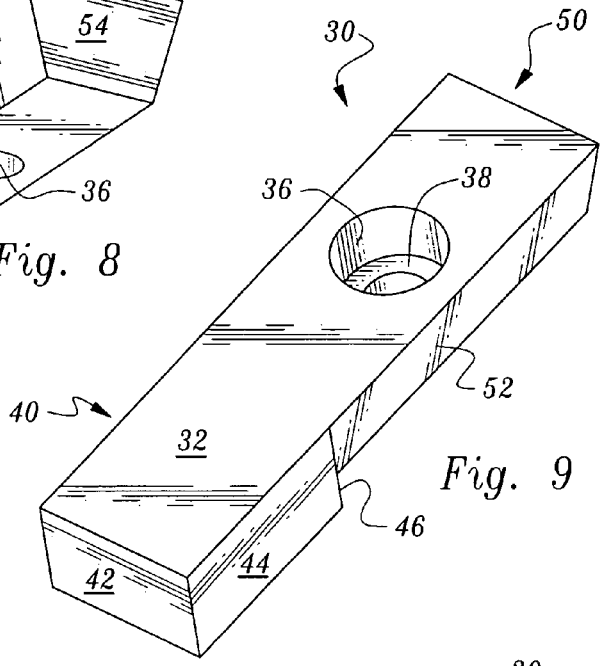
FIG. 9 is a perspective view of that which is shown in FIG. 4 when viewed from above with a vantage point more directly over the work stop than the vantage point provided with FIG. 4.
Figure 7:
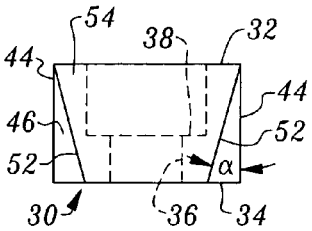
FIG. 7 is an end elevation view of that which is shown in FIG. 4.
Figure 5:
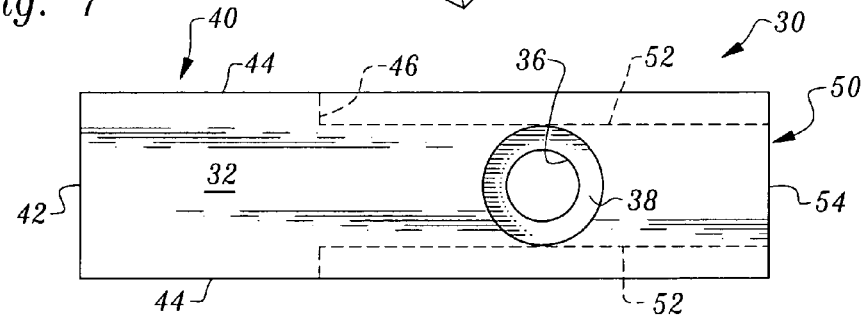
FIG. 5 is a top plan view of that which is shown in FIG. 4.
Figure 6:
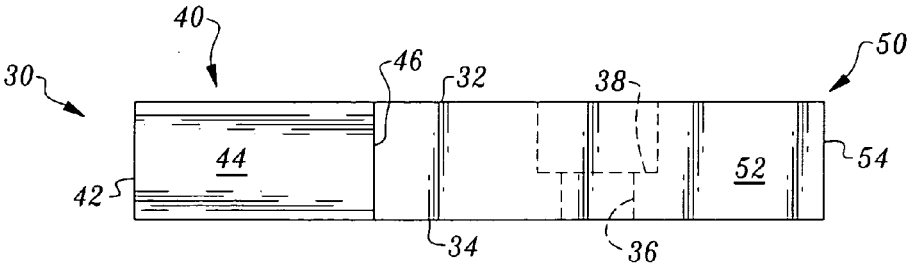
FIG. 6 is a side elevation view of that which is shown in FIG. 4.

In essence, and with particular reference to FIG. 3, particular details of the jaw 10 with the work stop, such as in the form of the key 30, are generally described. The jaw 10 of this invention replaces a standard vise jaw, with the jaw 10 being attachable with bolts 5 to a fixed end 4 of the vise 2. The jaw 10 includes a top 16 with grooves 20 formed therein. Preferably, a plurality of grooves 20 are provided as a preferred form of stop supporting slot, with each of the grooves 20 intersecting with a face 14 of the jaw 10.

At least one key 30, or other form of stop, is provided which is removably attachable to the jaw 10 through the grooves 20. Each key 30 includes a free portion 40 and a captured portion 50. The free portion 40 extends beyond the face 14 of the jaw 10 when the key 30 is coupled to the jaw 10. The free portion 40 is thus available to resist lateral motion of the work W (FIG. 1) and to locate the work W precisely where desired when the work W is held between the jaw 10 and the moving jaw 18, and with the free portion 40 of the key 30 adjacent the work W.

The captured end 50 of the key 30 is configured to be securely held within the groove 20 or other slot formed in the jaw 10. In addition to sizing and shaping the captured end 50 to fit within one of the grooves 20, or other slots, a screw 28 is provided to fit within appropriate holes in the captured end 50 to allow the screw 28 or other fastener to secure the key 30 within the groove 20.

More specifically, and with particular reference to FIGS. 1 and 2, details are described of the vise 2 with which the jaw 10 can be utilized. While the jaw 10 of this invention could function with many different types of vises, a standard vise 2 such as that which would be used on a milling machine is shown to illustrate the function of the jaw 10. This vise 2 includes a base 3 configured to be attachable to a floor of a milling region of a milling machine, or adjacent some other machine capable of performing operations upon a work piece W located within the vise 2 adjacent such a machine.

The vise 2 includes a fixed end 4 secured to the base 3 without motion between the fixed end 4 and the base 3. The vise 2 also includes a moving end 6 opposite the fixed end 4. The moving end 6 is adapted to move linearly in a primary direction toward and away from the fixed end 4, a horizontally. A secondary horizontal direction perpendicular to this primary direction of movement of the moving end 6 relative to the fixed end 4 is referred to as a "lateral" direction. Bolts 5 are provided which can be threadably attached to the fixed end 4 to secure a jaw to the fixed end 4, such as the jaw 10 of this invention. A moving jaw 18 is similarly attachable to the moving end 6, with the jaw 10 of this invention being locatable either upon the fixed end 4 or the moving end 6 (or both).

One prior art jaw J (FIG. 2) is known to attach to a vise 2 in a manner similar to attachment of the jaw 10 of this invention to the vice 2. The prior art jaw J includes a channel C running laterally along a top of the jaw J. A sliding stop S is adapted to reside within the channel C and slide within the channel C to various different positions to provide a mechanical stop for resisting lateral motion of a work piece W, and to assist in the proper positioning of the work W where desired.

With particular reference to FIG. 3, specific details of the jaw 10 of the preferred embodiment of this invention are described. The jaw 10 preferably has a general size and shape similar to that of the moving jaw 18 and similar to standard jaws which have not been modified as provided by this invention. Particularly, the jaw 10 preferably is a generally orthorhombic structure including a bottom 12 which is planar and parallel with a top 16. Sides 13 extend between the bottom 12 and the top 16 with the sides 13 perpendicular to the top 16 and bottom 12.

A face 14 is provided which extends between the sides 13 and between the bottom 12 and the top 16, with the face 14 perpendicular to the bottom 12, sides 13 and top 16. The face 14 is adapted to engage the work W. Holes 15 pass through the face 14 of the jaw 10 and entirely through the jaw 10 to receive bolts 5 for securing the jaw 10 to the fixed end 4 (or moving end 6) of the vise 2. These holes 15 preferably have a sufficient depth and with a step therein so that a head of the bolt 5 can reside within the jaw 10 somewhat and without extending beyond the face 14.

Unique to this invention, the jaw 10 includes at least one slot, and preferably a plurality of slots for receiving at least one stop therein. The slots within the jaw 10 can take on a variety of different configurations. Most preferably, the slots within the jaw 10 are provided in the form of grooves 20. These grooves 20 are formed within the top 16 of the jaw 10 and intersect with the face 14 of the jaw 10, preferably with a centerline of the groove 20 oriented perpendicular with the face 14. The groove 20 preferably exhibit a constant cross-sectional contour. This contour preferably includes a horizontal floor 22 below the top 16 with walls 24 extending from the floor 22 up to the top 16. These walls 24 preferably taper so that the walls 24 are further from each other adjacent the top 16 than their spacing adjacent the floor 22.

A threaded hole 26 is preferably provided extending vertically down into the floor 22. This threaded hole 26 includes threads adapted to receive a threaded fastener, such as a screw 28, after the screw 28 has passed through the stop, so that the screw 28 assists in holding the stop within the groove 20 or other slot within the jaw 10. While the walls 24 are not strictly required to taper, preferably the walls 24 do taper so that the grooves 20 are wider adjacent the top 16 than adjacent the floor 22. Such a taper facilitates the easy insertion and removal of one or more stops into one or more of the grooves 20. Preferably, an angle of taper of these walls 24 away from a vertical orientation is approximately 10°.

Figure 10:
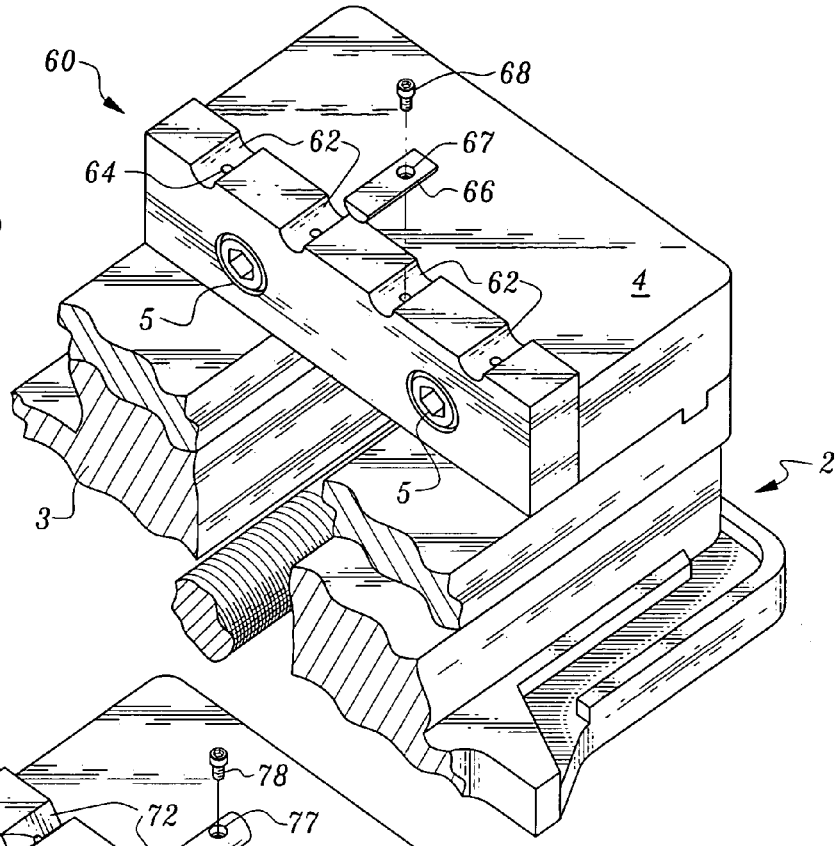
FIG. 10 is a perspective view of a portion of that which is shown in FIG. 1, but with a first alternative vise jaw and work stop shown therein.
Figure 11:
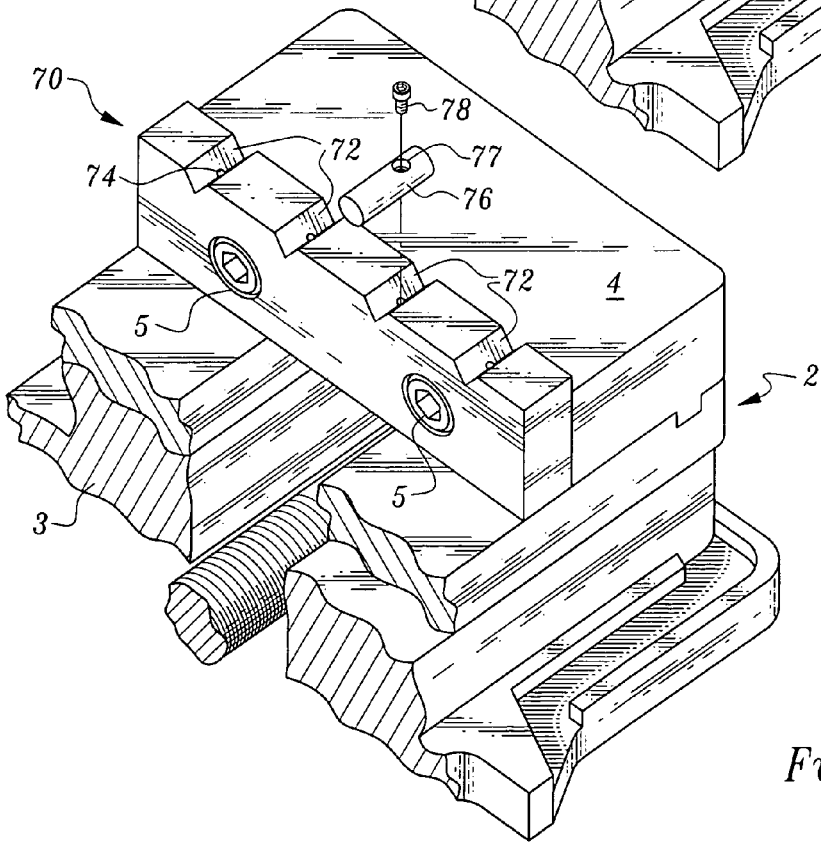
FIG. 11 is a perspective view similar to that which is shown in FIG. 10 but illustrating a second alternative jaw and work stop according to this invention.
Figure 12:
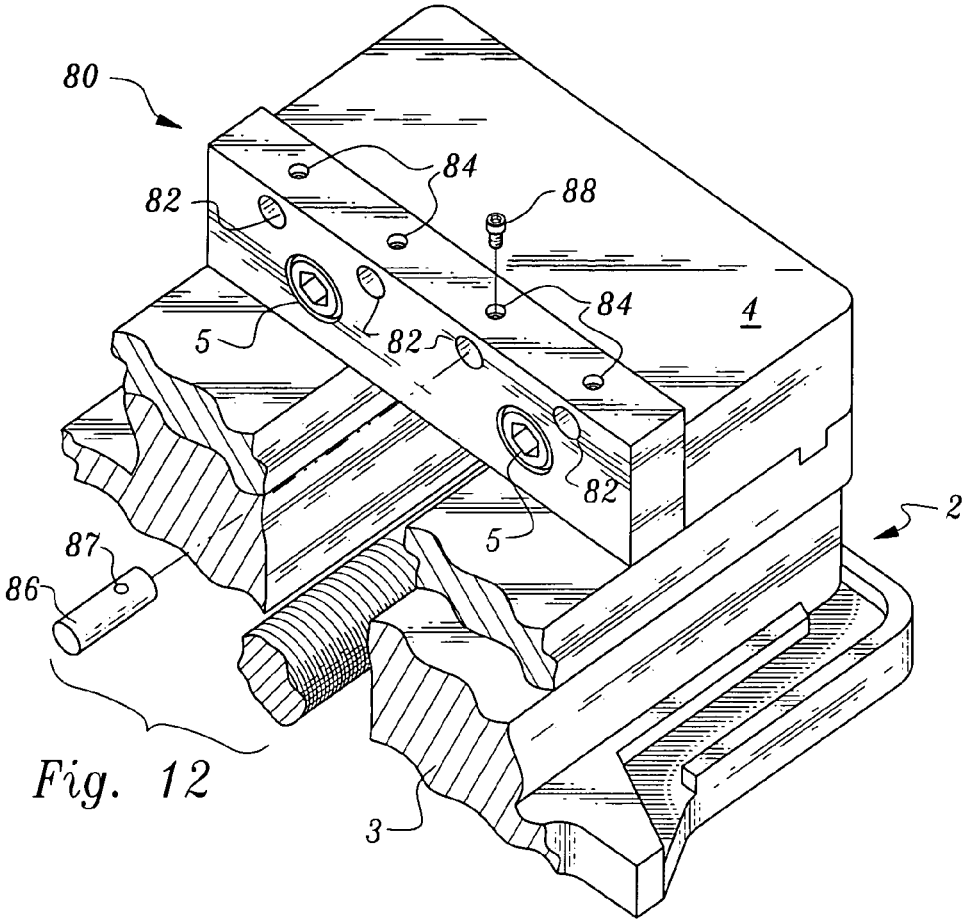
FIG. 12 is a perspective view similar to that which is shown in FIG. 10 but illustrating a third alternative vise jaw and work stop according to this invention.

While the slots are shown according to the preferred embodiment in the form of the grooves 20 as described above, the slots can have various different alternative forms, such as illustrated in FIGS. 10–12. The slots are preferably located within the top 16 of the jaw 10, but could alternatively be located below the top 16 and extending out of the face 14 (FIG. 12). Also, the shape of the slots and the size of the slots, as well as the position and number of the slots could be any of a variety of different configurations, provided that the slots can effectively receive a stop therein and securely hold the stop therein so that the work W can be held in a precise position and resist motion of the work W laterally relative to the vise 2 (FIG. 1).

With particular reference to FIGS. 4–9, particular details of the key 30, providing a preferred form of stop, are described. The key 30 is a unitary mass of rigid material which includes a free portion 40 and a captured portion 50. The free portion 40 is adapted to extend beyond the face 14 of the jaw 10 when the captured portion 50 is secured within one of the slots of the jaw 10, such as one of the grooves 20. While most preferably, a single key 30 is provided, alternatively multiple keys 30 can be provided residing in separate slots.

The key 30 includes an upper surface 32 parallel with and spaced from a lower surface 34. A bore 36 extends through the key 30 from the upper surface 32 to the lower surface 34, with a bore 36 preferably extending perpendicularly to these surfaces 32, 34. The bore 36 preferably includes a step 38 which causes the bore 36 to have a greater diameter adjacent the upper surface 32 than adjacent the lower surface 34. The stop engages a head of the screw 28 with the head recessed into the bore 36.

The free portion 40 of the key includes a front surface 42 which is preferably planar and extends perpendicularly between the upper surface 32 and the lower surface 34. The front surface 42 is adapted to reside in a plane substantially parallel with the face 14 of the jaw 10 when the captured portion 50 of the key 30 resides within one of the grooves 20 or other slots in the jaw 10.

The free portion 40 additionally includes side surfaces 44 which extend between the upper surface 32 and the lower surface 34 adjacent the front surface 42. The side surfaces 44 are preferably perpendicular to both the upper surface 32, lower surface 34 and front surface 42. The side surfaces 44 are adapted to engage sides of the work W to resist lateral motion of the work W relative to the vise 2 (FIG. 1). A transition 46 is provided at an edge of the side surfaces 44 opposite the front surface 42. The transition 46 defines a region on the key 30 where the free portion 40 changes in geometry to match a geometry of the captured portion 50.

The captured portion 50 most preferably has a contour matching the contour of the slots within the jaw 10. With the slots in the form of the grooves 20 of the preferred embodiment, the captured portion 50 preferably includes tapered surfaces 52 which extend between the upper surface 32 and the lower surface 34 of the key 30. The tapered surfaces 42 extend from the transition 46 to a rear surface 54 on an end of the key 30 opposite the front surface 42.

The tapered surfaces 52 are provided with an angle of taper a (FIG. 4) which preferably matches an angle of taper provided in the walls 24 of the grooves 20 in the jaw 10. For instance, if the walls 24 of the grooves 20 have an angle of taper of 10°, the angle of taper a of the tapered surfaces 52 of the captured portion 50 of the key 30 preferably are also 10°.

The width of the captured portion 50 between the tapered surfaces 52 and the height of the captured portion 50 between the upper surface 32 and lower surface 34 is preferably similar to corresponding measurements within the grooves 20 of the jaw 10. However, most preferably a width of the captured portion 50 of the key 30 is preferably slightly greater than a width of the grooves 20. In this way, the captured portion 50 will not quite touch the floor 22 before the tapered surfaces 52 engage the walls 24 within the grooves 20. Such a slight oversizing of the captured portion 50 thus ensures a secure abutment of the tapered surfaces 52 against the walls 24 of the grooves 20 with a large amount of surface area having intimate contact between the key 30 and the jaw 10.

Additionally, a thickness of the capture portion 50 between the upper surface 32 and lower surface 34 is preferably slightly less than the depth of the grooves 20, so that the key 30 tends to reside within the groove 20 without extending up above the top 16 of the jaw 10 in any way.

In use and operation, and with particular reference to FIGS. 1 and 3, details of the use and operation of the jaw 10 with the slot in the form of the grooves 20 and with the stop in the form of the key 30 are described in detail. Initially, a user selects a work piece W which is to be machined or otherwise held still, such as for a machining operation. The vise 2 is opened sufficiently so that the work W can fit between the jaw 10 and the moving jaw 18. The moving end 6 of the vise 2 is then adjusted until the jaw 10 and moving jaw 18 each engage opposite sides of the work W.

If it is important that the work W have a precise lateral location within the vise 2, or if concern exists that the work W might slide laterally, the jaw 10 according to this invention and a stop such as the key 30 is utilized. Particularly, the user first makes sure that the jaw 10 is installed adjacent the fixed end 4 (or alternatively the moving end 6 or both) of the vise 2.

Next, the user determines which of the grooves 20 is properly positioned to provide lateral support adjacent the work W. The key 30 is then positioned within that groove 20 with the captured portion 50 residing within the groove 20 and with the free portion 40 extending away from the face 14 and adjacent a lateral side of the work W. The screw 28 is then utilized by passing it through the bore 36 in the key 30 and into the threaded hole 26 within the floor 22 of the groove 20, so that the screw 28 or other fastener secures the key 30 within the groove 20. The user then places the work W directly adjacent the side surface 44 of the free portion 40 of the key 30 adjacent the work W and tightens the vise 2.

The work W is thus securely held in the precise position desired in both a primary horizontal direction and a lateral horizontal direction within the vise 2. The user can then perform the desired machining operation upon the work W. When a second work piece W needs to have a similar machining operation performed, the vise 2 is opened and the new work W is placed within the vise 2 with the work W abutting the jaws 10, 18 and abutting the key 30, so that an identical machining operation can be precisely performed.

With particular reference to FIG. 10, details of a first alternative jaw 60 and associated part round key 66 are described. In this alternative embodiment, all of the features are the same as with the preferred embodiment except those specifically described herein. The first alternative jaw 60 includes slots in the form of semi-circular troughs 62 formed within a top of the first alternative jaw 60. Threaded holes 64 are located within each of the troughs 62 similar to the threaded hole 26 of the preferred embodiment.

A part round key 66 is preferably provided which can reside within one of the troughs 62. The part round key 66 could alternatively be a key or other stop which is fully round, or other shapes. A bore 67 is provided within the part round key 66 which can be aligned with the threaded hole 64. A screw 68 is provided to secure the part round key 66 to the trough 62 by passing the screw 68 through the bore 67 and into the threaded hole 64.

With particular reference to FIG. 11, details of a second alternative jaw 70 and associated full round key 76 are described. With this second alternative jaw 70, the slots are provided in the form of V-grooves 72. The V-grooves 72 are similar to the grooves 20 of the preferred embodiment, except that no floor 22 (FIG. 3) is provided, but rather the sides of the V-grooves 72 extend down to a location where they join each other. A threaded hole 74 is provided within a bottom of each of the V-grooves 72.

While various different stops could be provided for use within the V-grooves 72, including complementally formed somewhat triangular stops, this second alternative embodiment illustrates use of a full round key 76 residing within the V-grooves 72. This second alternative embodiment thus illustrates how the stop need not have a fully complemental contour with that of the slot, to effectively operate according to this invention. The full round key 76 could alternatively be a part round key similar to that provided in the first alternative embodiment of FIG. 10 or could have other shapes. A bore 77 preferably passes through the full round key 76 so that a screw 78 or other threaded fastener can pass through the bore 77 and into the threaded hole 74 to secure the full round key 76 or other stop within the V-groove 72 of the second alternative jaw 70.

With particular reference to FIG. 12, particular details of third alternative jaw 80 and associated full round key 86 are described. With this third alternative jaw 80, the slots are provided in the form of cylindrical holes 82 which extend into the face 14 below the top 16 of the third alternative jaw 80. The third alternative jaw 80 is preferably fitted with top bores 84 which extend through the top and into the cylindrical holes 82. The top bores 84 are preferably not threaded but include a step therein.

A full round key 86 is sized to fit within the cylindrical holes 82. This full round key 86 preferably includes a threaded bore 87 which can be aligned with the top bore 84 so that a screw 88 can pass through the top bore 84 and into the threaded bore 87 to secure the full round key 86 within one of the cylindrical holes 82. The full round key 86 could alternatively be press fit within the cylindrical holes 82 or the full round key 86 could itself be threaded so that it threads into cylindrical holes 82 fitted with complemental threads.

Figure 13:
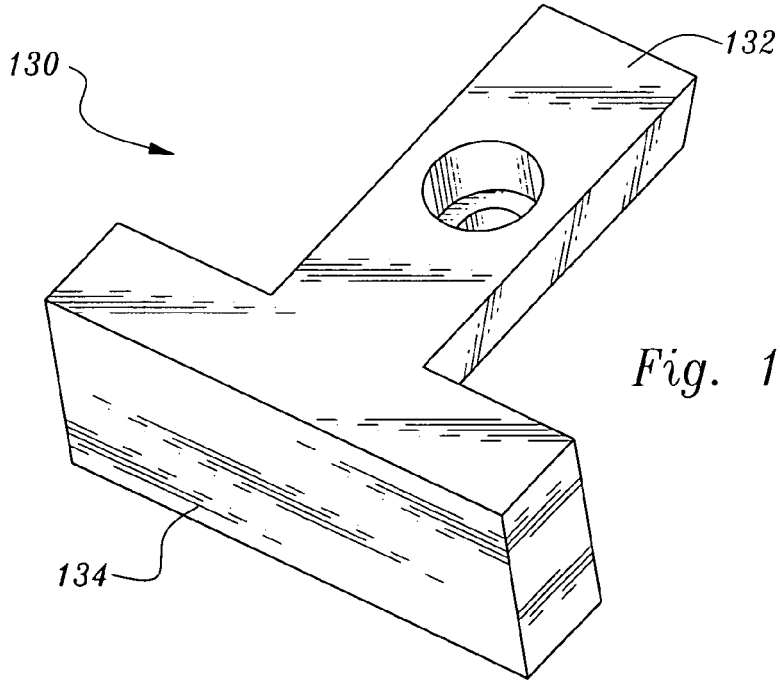
FIG. 13 is a perspective view of an alternative work stop according to this invention.

With particular reference to FIG. 13, an alternative key 130 is shown. This alternative key 130 includes a captured portion 132 similar to the captured portion 50 of the preferred embodiment, configured to fit securely within one of the grooves 20 in the jaw 10 of the preferred embodiment. The alternative key 130 uniquely includes a rectangular free portion 134 which has a greater width than the free portion 40 of the preferred embodiment. This alternative key 130 illustrates how various different keys of different free portion widths could be provided, to provide further specific positioning flexibility for the work W relative to the stops which are provided, so that the work W can be positioned precisely where desired in a lateral direction without requiring an excessive number of slots within the jaw 10.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A vise jaw with work stop, comprising in combination:

a vise jaw having a top opposite a bottom and a face extending between said top and said bottom, said face adapted to engage a work piece;

said top including at least one slot therein, said slot intersecting with said face;

at least one stop, said stop including a captured portion adapted to reside within said slot and a free portion adapted to extend out of said slot and beyond said face;

said stop adapted to be removably attached to said vise jaw; and wherein said slot is configured as a groove having a substantially constant cross-sectional form.

2. The apparatus of claim 1 wherein said top of said jaw is oriented parallel with said bottom of said jaw, with both said top and said bottom oriented perpendicular to said face.

3. The apparatus of claim 1 wherein said groove extends in a direction perpendicular to said face.

4. The apparatus of claim 1 wherein said groove includes a floor, said floor oriented in a plane parallel with said top of said vise jaw.

5. The apparatus of claim 4 wherein said groove includes tapered walls extending between said floor and said top at opposite sides of said floor.

6. The apparatus of claim 5 wherein said captured portion of said stop has tapered surfaces with an angle of taper matching an angle of taper of said tapered walls of said groove.

7. The apparatus of claim 1 wherein said groove includes a pair of walls which taper from a lower portion of said slot to a portion of said slot adjacent said top of said vise jaw, said tapered walls oriented non-perpendicular with said top of said vise jaw.

8. The apparatus of claim 7 wherein said captured portion of said stop includes at least a portion thereof with a cylindrical contour, said cylindrical contour sized to abut portions of said tapered walls of said slot.

9. The apparatus of claim 8 wherein said slot is configured as a V-groove with said tapered walls joined together at a lowermost portion of said slot.

10. A vise jaw with work stop, comprising in combination:

a vise jaw having a top opposite a bottom and a face extending between said top and said bottom, said face adapted to engage a work piece;

said top including at least one slot therein, said slot intersecting with said face;

at least one stop, said stop including a captured portion adapted to reside within said slot and a free portion adapted to extend out of said slot and beyond said face;

said stop adapted to be removably attached to said vise jaw; and wherein a threaded hole is provided within said groove, said captured portion of said stop including a bore therein adapted to be aligned with said threaded hole in said groove, such that a threaded fastener can pass through the bore and thread into said threaded hole to secure said stop within said groove.

11. The apparatus of claim 10 wherein said threaded hole extends perpendicularly into a floor in said groove, said floor oriented substantially parallel with said top of said vise jaw.

12. The apparatus of claim 10 wherein said threaded hole extends through a junction between a pair of tapered walls extending from said top of said vise jaw to a lowermost portion of said groove where said tapered walls come together, said threaded hole extending along a centerline substantially perpendicular with said top of said vise jaw.

13. The apparatus of claim 10 wherein said bore includes a step therein with portions of said bore above said step having a greater diameter than a diameter of a screw adapted to secure the stop within said groove, and with portions of said bore below said step having a diameter less than a diameter of said head of said screw and greater than a diameter of a threaded shaft of said screw.

14. The apparatus of claim 1 wherein said stop includes a key, said key including said captured portion therein having a size and shape complemental to a size and shape of said slot.

15. The apparatus of claim 14 wherein said captured portion of said key includes a pair of tapered surfaces on opposite sides of said key, said tapered surfaces adapted to abut walls of said slot.

16. The apparatus of claim 15 wherein said walls of said slot taper at an angle non-perpendicular to said top of said vise jaw, said taper of said walls of said slot having an angle matching an angle of said tapered surfaces of said captured portion of said key.

17. The apparatus of claim 14 wherein said free portion of said key has a different cross-sectional shape than a cross-sectional shape of said captured portion.

18. The apparatus of claim 17 wherein said free portion of said key includes size surfaces which are planar, parallel to each other and adapted to be oriented perpendicular to said face and said top surface of said vise jaw when said key has said captured portion residing within said slot.

19. The apparatus of claim 1 wherein said stop includes a key, said key having said captured portion with a circular cross-section, said slot having tapering side walls adapted to abut surfaces of said circular cross-section of said captured portion of said key when said key is located adjacent said slot.

20. The apparatus of claim 19 wherein said key includes a bore passing entirely therethrough, and wherein said slot includes a threaded hole therein, said bore in said key adapted to be alignable with said threaded hole in said slot, such that a threaded fastener can secure said key to said slot in said vise jaw.

21. A vise jaw with work stop, comprising in combination:

a vise jaw having a top opposite a bottom and a face extending between said top and said bottom, said face adapted to engage a work piece;

at least one slot formed in said jaw, said slot intersecting with said face;

at least one stop, said stop including a captured portion adapted to reside within said slot and a free portion adapted to extend out of said slot and beyond said face;

said stop adapted to move relative to said face; and wherein said slot is in the form of a groove in said top of said vise jaw, said groove exhibiting a substantially constant cross-sectional size and shape as said groove extends away from said face.

22. The vise jaw of claim 21 wherein a centerline of said groove is oriented perpendicular to said face.

23. The vise jaw of claim 21 wherein said slot is in the form of a hole located below said top of said vise jaw and extending through said face of said vise jaw.

24. The vise jaw of claim 23 wherein said hole has a substantially round cross-section, said stop sized to fit into said hole.

25. The vise jaw of claim 24 wherein said captured portion of said stop is substantially round with a size not greater than a size of said hole, such that said captured portion of said stop can pass into and out of said hole.

26. The vise jaw of claim 25 wherein said captured portion of said stop is adapted to be press fit into said hole.

27. The vise jaw of claim 25 wherein said captured portion of said stop is threaded and said hole is threaded with threads complemental to threads on said captured portion of said stop, such that said stop can be threaded into and out of said hole.

28. The vise jaw of claim 25 wherein said top of said vise jaw includes a top bore extending down through said top and into said hole, said captured portion of said stop including a threaded bore therein, said threaded bore adapted to be aligned with said top bore, and a threaded fastener adapted to pass through said top bore and into said threaded bore, such that said stop can be secured within said hole.

29. The vise jaw of claim 28 wherein a central axis of said hole is oriented perpendicular to said face of said vise jaw.

30. The vise jaw of claim 21 wherein said stop includes a key with said captured portion having a geometry matching a shape and a size of said slot, such that said captured portion of said key can fit within said slot.

31. The vise jaw of claim 30 wherein said slot is in the form of a groove extending down into said top of said vise jaw, said groove including tapering walls which extend downward from said top at an angle non-perpendicular to said top, said captured portion of said key including tapering surfaces, said tapering surfaces of said capture portion of said key having an angle matching an angle of said tapering walls of said groove.

32. The vise jaw of claim 31 wherein said tapering walls extend down from said top to a location where said tapering walls are joined together, such that said slot is configured as a V-groove.

33. The vise jaw of claim 31 wherein said groove includes a floor, said floor oriented parallel with said top and located below said top and between lower edges of said tapering walls.

34. The vise jaw of claim 33 wherein said floor includes a threaded hole extending perpendicularly into said floor, said captured portion of said key including a bore passing therethrough, said bore adapted to be aligned with said threaded hole in said floor, such that a threaded fastener can pass through said bore and into said threaded hole in said floor to secure said key to said slot.

* * * * *